United States Patent [19]

Gatti

[11] Patent Number: 4,726,292

[45] Date of Patent: Feb. 23, 1988

[54] FUSE FOR SUB-MUNITIONS TO BE EXPELLED FROM A ROCKET

[75] Inventor: Antonio Gatti, Milan, Italy

[73] Assignee: Fratelli Borletti S.p.A., Milan, Italy

[21] Appl. No.: 867,936

[22] Filed: May 29, 1986

[30] Foreign Application Priority Data

Jun. 28, 1985 [IT] Italy ..... 67592 A/85

[51] Int. Cl.[4] ..... F42C 15/12; F42C 15/18; F42C 15/32

[52] U.S. Cl. ..... 102/227; 102/388; 102/489

[58] Field of Search ..... 102/226–230, 102/223, 260, 254, 489, 388, 393

[56] References Cited

U.S. PATENT DOCUMENTS

| | | | |
|---|---|---|---|
| 1,690,331 | 11/1928 | Brayton | 102/227 |
| 1,751,616 | 3/1930 | Brayton | 102/227 X |
| 2,076,602 | 4/1937 | Towner | 102/227 |
| 2,131,037 | 9/1938 | Brayton | 102/227 |
| 3,273,834 | 9/1966 | Bower | 102/388 X |
| 3,712,217 | 1/1973 | Little et al. | 102/388 |
| 3,913,483 | 10/1975 | Wolterman | 102/226 X |
| 3,964,391 | 6/1976 | Zacharin | 102/388 |
| 3,998,164 | 12/1976 | Hadfield | 102/226 |

*Primary Examiner*—David H. Brown
*Attorney, Agent, or Firm*—Jeffers, Hoffman & Niewyk

[57] ABSTRACT

The sub-munition is provided with an arming device comprising a striker member, movable substantially in the direction of its longitudinal axis, and a detonator carried by a slide movable from a first position in which the detonator is located out of the path of the striker member to a second position in which the detonator is brought into the path of the said member and beneath it; the striker member is provided with a threaded stem screwed into a threaded hole of a bush movable axially on the body of the sub-munition in such a way that the striker member is brought from the said first to the said second position upon unscrewing of the stem from the threaded hole; a pair of strip form flexible elements are connected to the striker member, one end of which flexible elements is fixed to the striker member and each of which can be disposed, when the sub-munition is expelled from the projectile, in a twisted configuration in such a way that the aerodynamic forces acting on them cause a moment to be transmitted to the striker member to unscrew this member itself from the associated threaded hole.

5 Claims, 7 Drawing Figures

FUSE FOR SUB-MUNITIONS TO BE EXPELLED FROM A ROCKET

BACKGROUND OF THE INVENTION

The present invention relates to a fuse for sub-munitions of the type which are carried by a projectile and are expelled from this to fall on the target.

Such sub-munitions are disposed within a suitable container housed in a projectile which is provided with an expulsion charge which is activated at a determined point of the trajectory of the projectile itself in such a way as to expel the sub-munitions; each of these, in the first part of the trajectory which starts after their expulsion, is given the same movement as has been imparted to the projectile and therefore, if this is constituted by a shell fired from a gun of conventional type, each sub-munition as well as following a predetermined trajectory, is also provided with a rotary motion substantially about its longitudinal axis.

The fuses of sub-munitions of the type indicated are normally provided with an arming device comprising a striker member movable substantially in the direction of its longitudinal axis and a detonator carried by a slide movable from a first position, in which the said detonator is located out of the path of the striker member to a second position in which the detonator is, on the other hand, carried into the path of the member itself and beneath this. The striker member is movable from a first position in which it prevents the displacement of the said slide, to a second position in which it allows the displacement of the slide itself; for the purpose of generating the axial displacement of the striker member from the first to the second position first noted, this is normally provided with a threaded stem screwed into a corresponding threaded hole of a small bush movable axially within the body of the fuse, in such a way that the striker member can be brought from the first to the second position first defined following unscrewing of the threaded stem from the corresponding threaded hole. When the striker member is located in this second position the slide is displaced by the action of a spring from the first to the second position first defined and therefore the fuse is in its armed configuraton in which the striker member is above the detonator and controls the explosion of the associated charge when, because of the striking of the sub-munition on the ground, the inertial force of the striker member itself thrusts this against the detonator.

In fuses of the type described, at the upper end of the striker member there is normally connected a flexible element of annular form which is normally folded in a pack above the fuse when the associated sub-munition is located within the projectile and which disposes itself in an open configuration because of the aerodynamic forces which act on it after the sub-munition has been ejected from the projectile. Since the sub-munition is given a rotary motion, and because of the aerodynamic resistance generated by the said flexible element, this latter tends to oppose the rotation of the sub-munition in this way giving rise to a moment on the striker member to which the flexible element is connected; the said moment generates a rotation of the striker member with respect to the body of the fuse, and therefore causes the unscrewing of the striker member itself from the corresponding threaded hole first mentioned, in such a way as to bring the striker member from the first position to the second position previously described.

Fuses of the type described have various disadvantages. First of all, these are not adapted to be utilised on sub-munitions which are expelled from projectiles which have not been provided with a rotary movement about their longitudinal axis, as occurs when such projectiles constitute the head of a rocket. In this case, in fact, each sub-munition is not given a rotary movement and therefore the aerodynamic actions acting on the ring shape deformable element do not generate any moment tending to make the striker member rotate with respect to the fuse and therefore the unscrewing of this from the corresponding threaded hole in which it is screwed.

Moreover, such fuses are not very reliable because of the manner of connection of the ring-shape deformable element with the striker member: such connection, in fact, is formed simply by clamping the flexible elements between a pair of washers in turn fixed, by means of a plastics deformation operation, to an end pin of the striker member itself.

Finally, the operations of assembly of the various parts of the fuse and assembly of this on the associated sub-munition are rather difficult because of the presence of the deformable element which, in its stack-folded configuration, impedes access to some of the parts of the fuse.

SUMMARY OF THE INVENTION

The object of the present invention is that of providing a fuse of the first indicated type, which will be free from the noted disadvantages, and which will therefore be able to be utilised also on sub-munitions which are not provided with rotary movement about their longitudinal axis, which have a high reliability and which can be mounted on and connected to the sub-munition in a simple and rapid manner.

Another object of the present invention is that of providing a fuse of the type indicated which, when it is utilised on sub-munitions provided with a rotary movement about their longitudinal axis, allows the perforating action of the sub-munition itself to be significantly increased by notably reducing, in the latter part of the trajectory of the sub-munition itself, the kinetic energy due to the said rotary movement about the longitudinal axis of the sub-munition.

The said objects are achieved by means of a fuse for sub-munitions to be expelled from a projectile, provided with an arming device comprising a striker member movable substantially in the direction of its longitudinal axis and a detonator carried by a slide movable from a first position in which the said detonator is located out of the path of the said striker member and a second position in which the detonator is brought into the path of the said member and beneath it, the said striker member being movable from a first position in which it prevents the displacement of the said slide and a second position in which it allows the displacement of the slide itself and the said striker member being provided with a threaded stem screwed into a threaded hole of a sleeve movable axially on the body of the fuse in such a way that the said striker member is brought from the said first to the said second position upon unscrewing of the said stem from the said threaded hole, characterised by the fact that the said striker member includes a pair of strip form flexible elements one end of which is fixed to the said striker member, and each of which is able to give rise, when the said sub-munition is expelled from the projectile, to a twisted element having a substantially rectilinear axis, in such a way that, by the aerodynamic action acting on it, a moment is transmitted to the said striker member to unscrew the said striker member from the said threaded hole.

BRIEF DESCRIPTION OF THE DRAWINGS

For a better understanding of the present invention there is now given, by way of example, a more detailed description of it with reference to the attached drawings, in which.

DETAILED DESCRIPTION OF THE INVENTION

Figure 1:
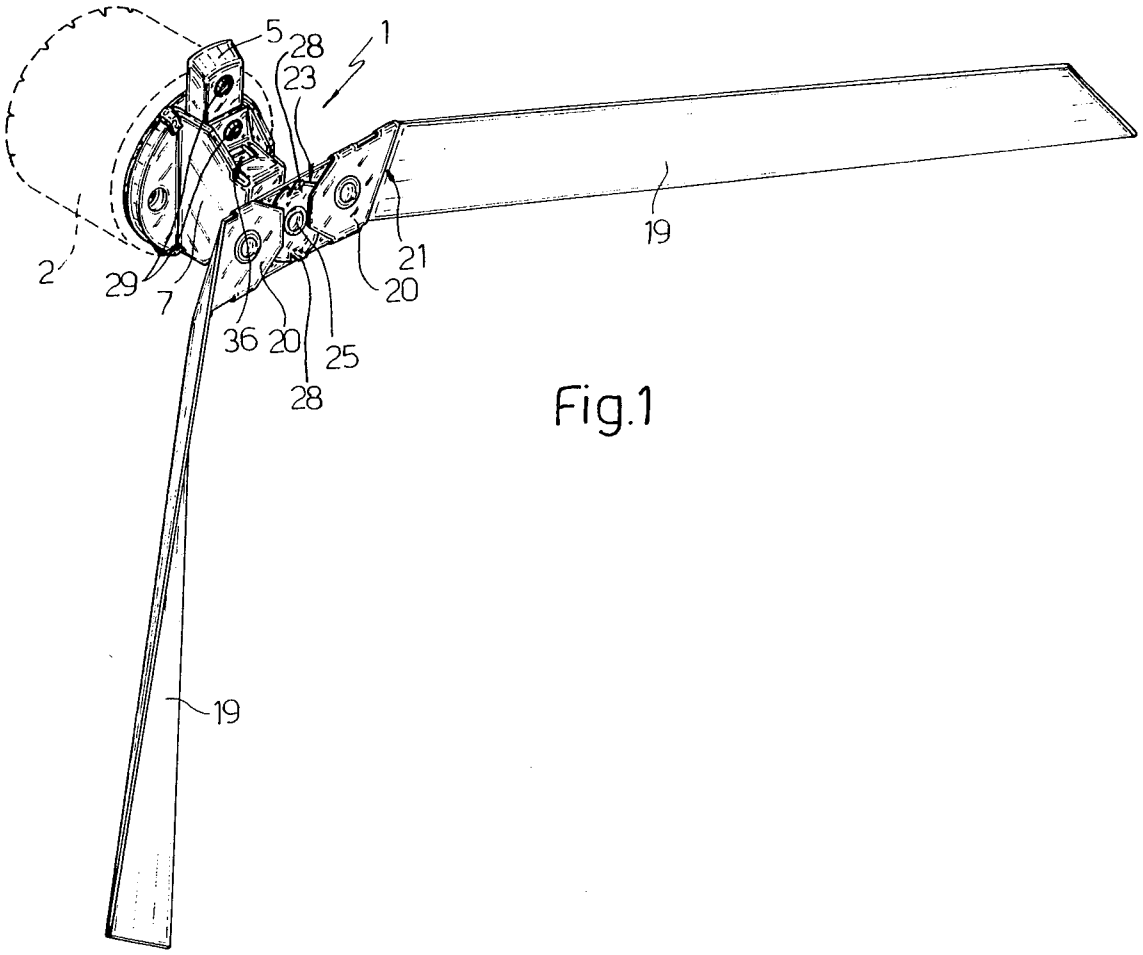
FIG. 1 is a schematic perspective view of the fuse of the invention in the configuration in which this is disposed during the movement of the sub-munition to which the fuse itself is fixed.

The fuse of the invention, generally indicated 1, is fixable to the upper part of a sub-munition 2. This fuse is provided with an arming device substantially comprising a striker member 3 movable axially in the direction of its longitudinal axis, and a detonator 4, carried by a slide 5 movable from a first position (shown in FIG. 1) in which the detonator is located out of the path of the striker member 3, to a second position in which the detonator is brought into the path of the member and beneath a conical tip 6 with which the member itself is provided.

The striker member 3 and the detonator 4 are movable in suitable seats formed in a body 7 of the fuse and the first substantially comprises a stem provided with a threaded section 9 normally screwed into a corresponding threaded hole of a small bush 10 axially movable within the body 7 but prevented from rotating with respect thereto; this striker member is movable from a first position (shown in FIG. 1) in which the conical tip 6 is inserted into a corresponding conical seat of the slide 5 to prevent the displacement of this latter, to a second position in which it allows the displacement of the slide itself; the striker member 3 can comprise, as in the embodiment of FIG. 1, a cylindrical section 12 the diameter of which is less than the internal diameter of the threading formed in the bush 10, as well as an annular projection 15; therefore the first defined second position of the striker member 3 can be reached when the threaded section 9 is completely unscrewed from the corresponding threaded hole of the bush 10 and the cylindrical section 12 of the member itself is located within the hole in this bush.

The slide 5 can pass from the first to the second position defined above by the action of a spring 16, and is stopped in the said position by the action of a shoulder 17 pre-arranged to abut against a corresponding tab 18 of the body 7.

The striker member 3 is provided with a pair of strip form flexible elements 19, one end of which is fixed to the striker member itself and each of which can be disposed, when the sub-munition is expelled from the projectile, in a manner which will be described, in the configuration schematically shown in FIG. 1 in which each of the said sections forms a twisted element having a substantially rectilinear axis.

Each flexible element 19 is provided in correspondence with the zone of connection with the striker member 3, with a reinforcing plate 20 (FIG. 1) conveniently made of metal sheet, the edge 21 of which facing the free end of the element itself is substantially rectilinear and forms an angle other than 90° with the longitudinal axis of the flexible element for the purpose of making this assume a predetermined twist.

Conveniently, each plate 20 has tongues folded onto the flexible element 19 and is fixed to this in any convenient manner, for example by means of riveting.

Figure 6:
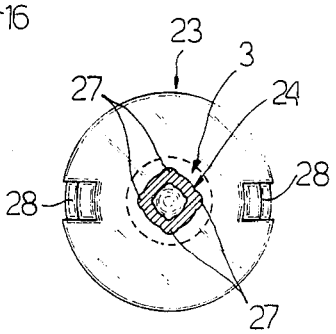
FIG. 6 is a section through the fuse taken on the line VI—VI.

The ends of the flexible elements 19 which are fixed to the striker member 3 are disposed between a pair of washers 22 and 23 (FIG. 3) which are coupled to an end pin 24 of the member itself, which is plastically deformed in such a way as to form a head 25 to clamp the washers and the flexible elements against a corresponding shoulder of the striker member 3. Conveniently, the washer 23 is provided, as is clearly seen in FIG. 6, with a plurality of notches 27 which can be filled with the material of the pin 24 when this is plastically deformed; the washer itself is then provided with a pair of radial teeth 28 each of which projects upwardly with respect to the washer itself and is able to cooperate with a corresponding edge of one of the plates 20.

Holes 29 are formed in the slide 5 and in the body 7, which holes have substantially coincident axes when the slide itself is located in the first, previously defined position and are able to receive a pin 34, the purpose of which is to prevent the diplacement of the slide 5 and therefore to constitute a safety pin for the arming system; the same purpose is performed by a cotter pin 35 which is inserted into a transverse slot 36 of the body 7 in such a way as to lock the axial displacement of the bush 10 and therefore of the striker member 3.

Figure 3:
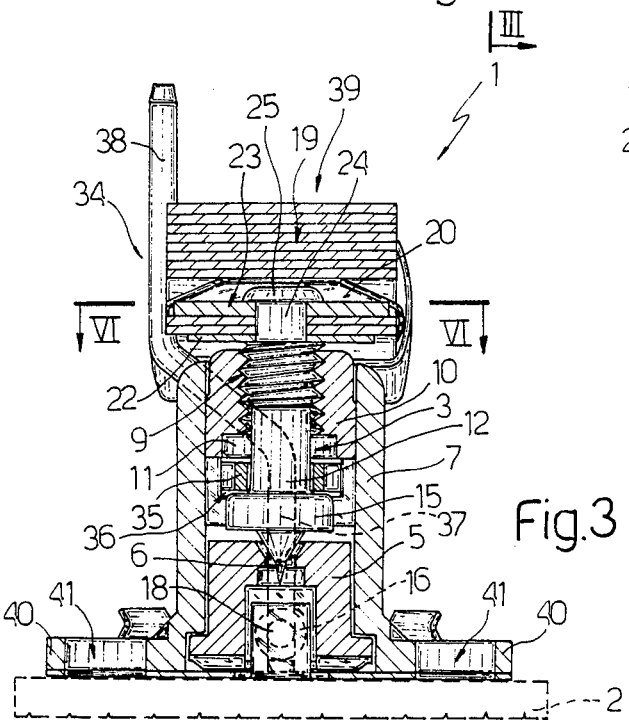
FIG. 3 is a section through the fuse of FIG. 1, taken on the line III—III.

The pin 34, as is cleary seen in FIG. 3, substantially comprises two substantially parallel sections 37 and 38, the first of which is inserted into the holes 29 whilst the second is located substantially on one side of the slide 5 for the purpose of allowing the assembly of the two flexible elements 19, suitable folded, to be disposed above the slide itself in such a way as to form a pack 39.

Figure 7:
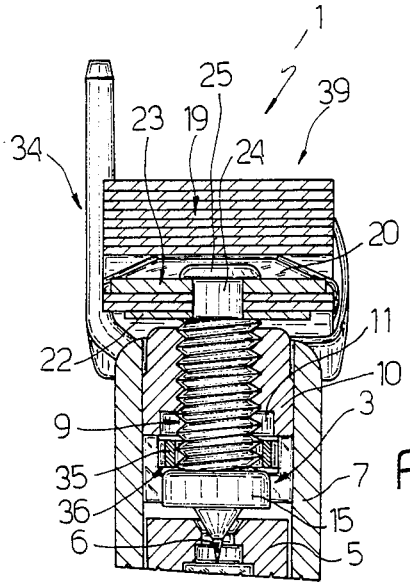
FIG. 7 is section similar to that of FIG. 3, showing a second embodiment of the fuse of the invention.

The embodiment of FIG. 7 differs from that shown in FIG. 3 by the fact that the stem of the striker member 3 is completely threaded as far as the annular projection 15. This second embodiment allows means to be formed, in a manner which will be explained, for the purpose of preventing rotation of the striker member when this has been brought into the first-defined second position.

The assembly of the fuse onto the associated sub-munition can be effected in the following manner.

Figure 2:
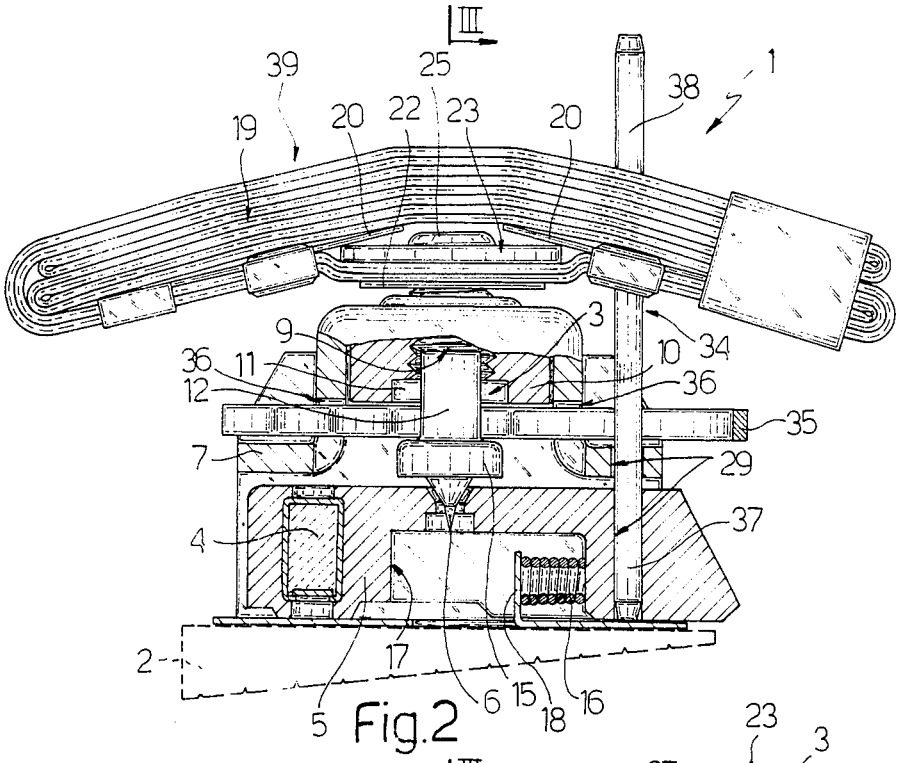
FIG. 2 is an axial section through the fuse of the invention.
Figure 4:
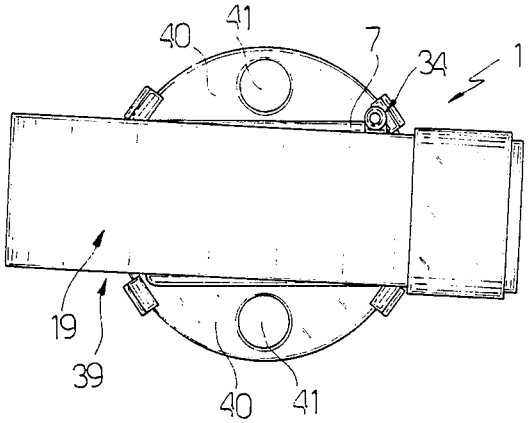
FIG. 4 is a plan view of the fuse in a first configuration during its assembly on the associated sub-munition.

The pack 39 of flexible elements 19 is positioned with respect to the body 7 of the fuse as illustrated in FIGS. 2 and 4, in which that is to say, the longitudinal axis of the pack itself is substantially parallel to that of the slide 5. This configuration can be obtained by making the striker member 3 to which the pack itself is rigidly connected rotate with respect to the associated bush 10; in this position the pin 34 does not interfere with the pack 39, the section 38 of the pin itself being disposed on one side of the slide 5 and therefore to one side of the pack itself as is clearly seen in FIG. 3. In the said position of the pack 39 the two tongues 40 (FIG. 4) of the body 7 are completely uncovered and accessible, these being provided with holes 41 in which can be inserted corresponding screws to fix the fuse to the sub-munition 2.

Figure 5:
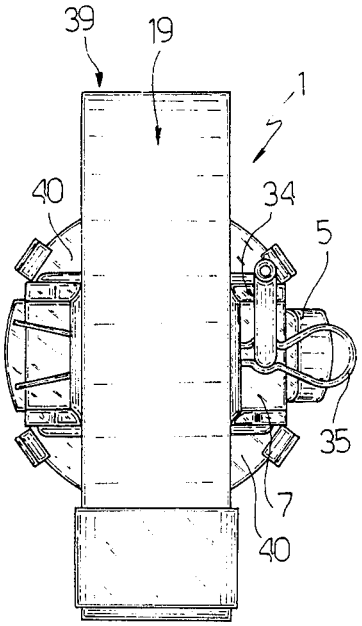
FIG. 5 is another plan view similar to that of FIG. 4 in the configuration in which the fuse is disposed at the end of its assembly on the sub-munition.

For the purpose of this fixing operation the pack 39 can be turned substantially through 45° in such a way as to align the longitudinal axis of the pack itself substantially with that of the slide 5 as is clearly seen in FIG. 5; in the said configuration, by acting on the end sections of the pack itself, this can be put into a less bulky configuration such as that necessary to be able to fit the sub-munition itself into the interior of the associated housing provided in the projectile which will have to transport the sub-munition itself.

After each sub-munition has been expelled from the associated projectile, the aerodynamic actions acting on the pack 39 open this and free the flexible elements 19 which therefore tend to become disposed in the configuration shown in FIG. 1, that is to say in which each of these has the form of a twisted element with a substantially rectilinear axis, substantially similar to that of the blade of a helicopter; in fact, because of the presence of the edges 21 of the plate 20 the said flexible elements tend to be folded along the edges themselves and therefore to assume a twisted configuration.

The aerodynamic forces which therefore act on each flexible element 19 in the said configuration generate on it a moment which tends to make the element itself rotate about the axis of the striker member 3, and therefore to make this unscrew from the corresponding threaded hole of the bush 10. In this way unscrewing of the member itself is caused until the threaded section 9 becomes free from the corresponding threaded hole of the bush 10 and therefore the cylindrical section 12 thereof traverses this hole until the annular projection 15 comes into contact against the corresponding shoulder on the bush 10. The slide 5 therefore becomes displaced under the action of the spring 16 until it is diposed in the first-defined second position, in which the detonator 4 is located substantially aligned with the axis of the striker member 3. When the sub-munition touches the ground, the inertia forces generated by the assembly constituted by the striker member 3 and the bush 10 cause the conical tip 6 of the striker member to be thrust against the detonator 4 causing it to explode.

A fuse constructed according to the embodiment of FIGS. from 1 to 3 can be used if the sub-munition is to be expelled from a projectile which is not provided with rotary movement and therefore one which is constituted, for example, by the head of a rocket. If, on the other hand, this projectile is provided with rotary movement, that is if it is constituted, for example, by a projectile shot from the mouth of a conventional gun, the fuse of the embodiment of FIG. 7 can be preferably utilised. In this case the rotation of the striker member 3 controlled by the flexible sections 19 is stopped when the annular projection 15 of the member itself comes to rest against the corresponding shoulder of the bush 10. In this way the assembly comprising the flexible elements 19 and the striker member 3 are no longer free, as was the preceding case, with respect to the fuse, but are rigidly connected thereto; consequently, the aerodynamic forces which act on the flexible elements 19 transmit to the sub-munition a moment which tends to oppose the rotation of the sub-munition itself and therefore significantly reduce the energy of rotation of this, therefore increasing the perforation action of the sub-munition itself when this comes into contact with the objective. In fact, it is known that this penetration action is greater when the sub-munition is provided with less energy of rotation or when such rotation is entirely absent.

The connection made in the manner described, between the flexible elements 19 and the striker member 3 is very reliable; in fact, the washer 23 is torsionally locked with respect to the pin 24 because of the material of the pin itself which is introduced into the slots 27 of the washer; on the other hand, if the locking of the ends of the flexible elements 19 formed by means of the two washers 22 and 23 were not sufficient for the transmission of the moment from the flexible elements to the striker member, and therefore relative rotation took place between these members, as soon as the edges of the small plate 20 of the flexible elements 19 came into contact with the corresponding teeth 28 of the washer 23, these latter would be able to draw the flexible elements into rotation.

It is evident that modifications and variations can be introduced to the embodiments of the present invention described, both as far as the form and disposition of the various parts are concerned, without departing from the scope of the invention.

I claim:

1. A fuse for a sub-munition to be expelled from a projectile, said sub-munition having a fuse body, an arming device comprising a striker member movable substantially in the direction of its longitudinal axis, and a detonator carried by a slide movable from a first position in which the said detonator is located out of the path of the said striker member to a second position in which the detonator is brought into the path of the said member and beneath it, the said striker member being movable from a first position in which it prevents the displacement of the said slide to a second position in which it allows the displacement of the slide and the said striker member, said striker member being provided with a threaded stem screwed into a threaded hole of a bush which is axially movable relative to the fuse body in such a way that said striker member is brought from the said first position to the said second position upon unscrewing of the said stem from the said threaded hole, characterised in that the said striker member includes a pair of flexible strip form elements one end of each of which is fixed to the said striker member for forming a pair of helicopter blade means acted on by aerodynamic forces when the said sub-munition is expelled from the projectile for transmitting a moment to the striker member by the aerodynamic forces acting on said blade means independently of any spinning motion of said fuse body and sub-munition to unscrew the said striker member from the said threaded hole, each of said strip form elements having a plurality of folds therein and being folded into a stacked pack on said arming device, each of said flexible elements being provided with a small reinforcing plate fixed to the element close to the region of attachment of the element to the striker member, the edge of the said plate facing the free end of the flexible element being rectilinear and forming an angle other than 90° with the longitudinal axis of the flexible element for the purpose of causing the flexible element to assume a predetermined twist.

2. A fuse according to claim 1 including a pair of washers coupled to an end pin of the said striker member, one end of each of the said flexible elements being disposed between said pair of washers, the said pin being plastically deformed to lock the said washers and the said ends to the said striker member, one of the said washers being provided with stop teeth each of which can cooperate with one of the said reinforcing plates to draw said plates into rotation and being provided with at least one radial notch to be filled with the material of the said pin when said pin is plastically deformed.

3. A fuse according to claim 1 including means operable to prevent the rotation of the said striker member when said striker has been brought into said second position whereby said moment which is transmitted to the said striker member is transmitted by said striker member to the said fuse body for the purpose of resisting the rotation of the sub-munition.

4. A fuse according to claim 1, characterised by the fact that the said means includes a shoulder formed in immediate proximity to the said threaded stem for cooperation with an abutment surface of the said bush to prevent rotation of the threaded stem when said shoulder is brought into contact with said abutment surface.

5. A fuse for a sub-munition to be expelled from a projectile, said sub-munition having a fuse body, an arming device comprising a striker member movable substantially in the direction of its longitudinal axis, and a detonator carried by a slide movable from a first position in which the said detonator is located out of the path of the said striker member to a second position in which the detonator is brought into the path of the said member and beneath it, the said striker member being movable from a first position in which it prevents the displacement of the said slide to a second position in which it allows the displacement of the slide and the said striker member, said striker member being provided with a threaded stem screwed into a threaded hole of a bush which is axially movable relative to the fuse body in such a way that the said striker member is brought from the said first position to the said second position upon unscrewing of the said stem from the said threaded hole, characterized by the fact that the said striker member includes a pair of folded flexible strip form elements one end of each of which is fixed to the said striker member for forming a pair of helicopter blades when the said sub-munition is expelled from the projectile whereby a moment is transmitted to the striker member by the aerodynamic forces acting on said blades to unscrew the said striker member from the said threaded hole, wherein the said fuse body includes at least a pair of holes by means of which the fuse can be fixed to the sub-munition, and the said slide is movable in a direction substantially orthogonal to a plane through the centers of the said holes, a locking pin adopted for insertion into aligned holes in said fuse body and the slide to lock the slide to said fuse body , characterised by the fact that the said pin includes two parallel but non coaxial end sections such that the upper section of the said pin is located to one side of the said slide whereby said folded flexible elements may be disposed in a pack above the said slide.

* * * * *